US007665677B2

(12) United States Patent
Montag

(10) Patent No.: US 7,665,677 B2
(45) Date of Patent: Feb. 23, 2010

(54) GRANULAR MATERIAL GRINDER AND METHOD OF USE

(75) Inventor: Roger A. Montag, West Bend, IA (US)

(73) Assignee: R A Montag, LLP, West Bend, IA (US)

( * ) Notice: Subject to any disclaimer, the term of this patent is extended or adjusted under 35 U.S.C. 154(b) by 0 days.

(21) Appl. No.: 12/044,648

(22) Filed: Mar. 7, 2008

(65) Prior Publication Data

US 2008/0173738 A1 Jul. 24, 2008

Related U.S. Application Data

(62) Division of application No. 11/620,234, filed on Jan. 5, 2007, which is a division of application No. 10/953,652, filed on Sep. 29, 2004, now Pat. No. 7,159,807.

(51) Int. Cl.
*B02C 19/06* (2006.01)
*B02C 23/24* (2006.01)

(52) U.S. Cl. ..... 241/19; 241/27; 241/188.1

(58) Field of Classification Search ..... 241/27, 241/188.1, 6, 18, 19, 23
See application file for complete search history.

(56) References Cited

U.S. PATENT DOCUMENTS 997,592 A 7/1911 Abbe
2,752,097 A * 6/1956 Lecher ..... 241/17
3,602,164 A 8/1971 Reintjes
3,630,754 A 12/1971 Wayne
3,632,051 A 1/1972 Rado
4,061,274 A 12/1977 Williams
4,460,393 A 7/1984 Saget
4,641,792 A 2/1987 Villavicencio
4,690,697 A 9/1987 Schwartz
4,852,811 A * 8/1989 Adams et al. ..... 241/1
4,862,224 A * 8/1989 Ku ..... 399/121
4,979,438 A 12/1990 Mendoza
5,271,570 A 12/1993 Satake
5,544,821 A 8/1996 Gupta
5,826,807 A 10/1998 Csendes
5,839,673 A 11/1998 Williams
5,846,591 A 12/1998 Satake
5,848,754 A 12/1998 Becker
5,850,977 A 12/1998 Csendes
6,179,231 B1 1/2001 Csendes
6,394,371 B1 5/2002 Ribardi
2002/0086097 A1 7/2002 Bommel

* cited by examiner

*Primary Examiner*—Faye Francis
(74) *Attorney, Agent, or Firm*—McKee, Voorhees & Sease, P.L.C.

(57) ABSTRACT

A granular material grinder and method of use includes a hammer mill for reducing incoming granular material into particulate material, a microgrinder for reducing the particulate matter into microground powder by particulate matter to particulate matter collisions, and a product collector to collect the microground powder portion. The granular material grinder having the feature of being operated in a closed system to facilitate efficient recovery of grain into microground powder and operable in a cooled inert gas to prevent any compound degradation due to temperature or oxygen.

13 Claims, 3 Drawing Sheets

GRANULAR MATERIAL GRINDER AND METHOD OF USE

CROSS-REFERENCE TO RELATED APPLICATIONS

This application is a Divisional Application of U.S. application Ser. No. 11/620,234 filed Jan. 5, 2007, which is a Divisional Application of U.S. Ser. No. 10/953,652 filed Sep. 29, 2004, which applications are hereby incorporated by reference in their entirety.

BACKGROUND OF THE INVENTION

The grinding of particulate matter has involved a number of different approaches all of which present varying problems. Grinders in the prior art typically use blades or impellers to mechanically break down granular material into smaller pieces. However, this mechanical breakage is limited to the interaction of the blades or impellers upon the granular material. Accordingly, it is an objective of the present invention to create an environment which is influenced by impellers but does not require direct contact by the impellers upon the particulate matter to greatly reduce size.

Also in the prior art, grinders have been developed which grind material in a water or liquid environment in order to achieve a reduced particle size. However, water or liquid processing creates problems such as the leaching of soluble solids from the granular material and also creates the high energy problem of removing the water or liquid once the granular material is ground into powder. Accordingly, a further objective of the present invention is the provision of a granular material grinder that reduces particle size without the use of a water or liquid as a carrier.

U.S. Pat. No. 2,752,097 to Lecher discloses a grinder for producing ultra fine particles which creates vortexes around rotating paddle wheels which causes particles to strike the outside wall. However, Lecher is a low volume system that creates high heat that must be cooled with a large air volume. In addition, the Lecher environment is subject to stresses that may damage the equipment. Accordingly, a further objective of the present invention is to produce a granular material grinder that does not emphasize particle collision with the inside of the chamber or impellers and has a lower operating temperature.

The market place is demanding materials that are microground and yet their chemical composition is not changed. For example, even slight changes in chemical compositions of pharmaceutical products or dietary supplements may inactivate the chemical composition or physical characteristic. Accordingly, a still further objective of the present invention is to control the operating parameter such that the temperature, carrier gas, and mechanical interaction do not damage these critical commercial products.

Another objective of the present invention is the provision of a method and process for grinding granular material that is economical and safe.

These and other objectives will become apparent from the following description.

BRIEF SUMMARY OF THE INVENTION

The foregoing objectives may be achieved by an apparatus for grinding granular material having a hammer mill that reduces incoming granular material into particulate material that is temperature controlled, a microgrinder receiving the particulate material from the hammer mill that has an impeller rotatably mounted that accelerates the particulate matter to strike against itself to create microground product, and a product collector which collects the microground powder so that it may be packaged.

The foregoing objectives may also be achieved by a process for grinding granular material that involves a first grinding step which reduces the size of grain into particulate pieces for mechanical breakage, a second grinding which reduces the size of particulate pieces through particulate piece to particulate piece collisions to form microground product, and a separating step to remove the microground product from the particulate pieces.

The foregoing objectives may also be achieved through a method of grinding particulate matter comprising suspending particulate matter in a flow of carrier gas and propelling particulate matter using the impeller to strike against a particulate matter going toward the impeller to fracture the particulate matter.

BRIEF DESCRIPTION OF THE DRAWINGS

FIGS. 4A-C are an enlarged view of particulate matter colliding to form microground product.

DETAILED DESCRIPTION OF THE PREFERRED EMBODIMENT

Figure 1:
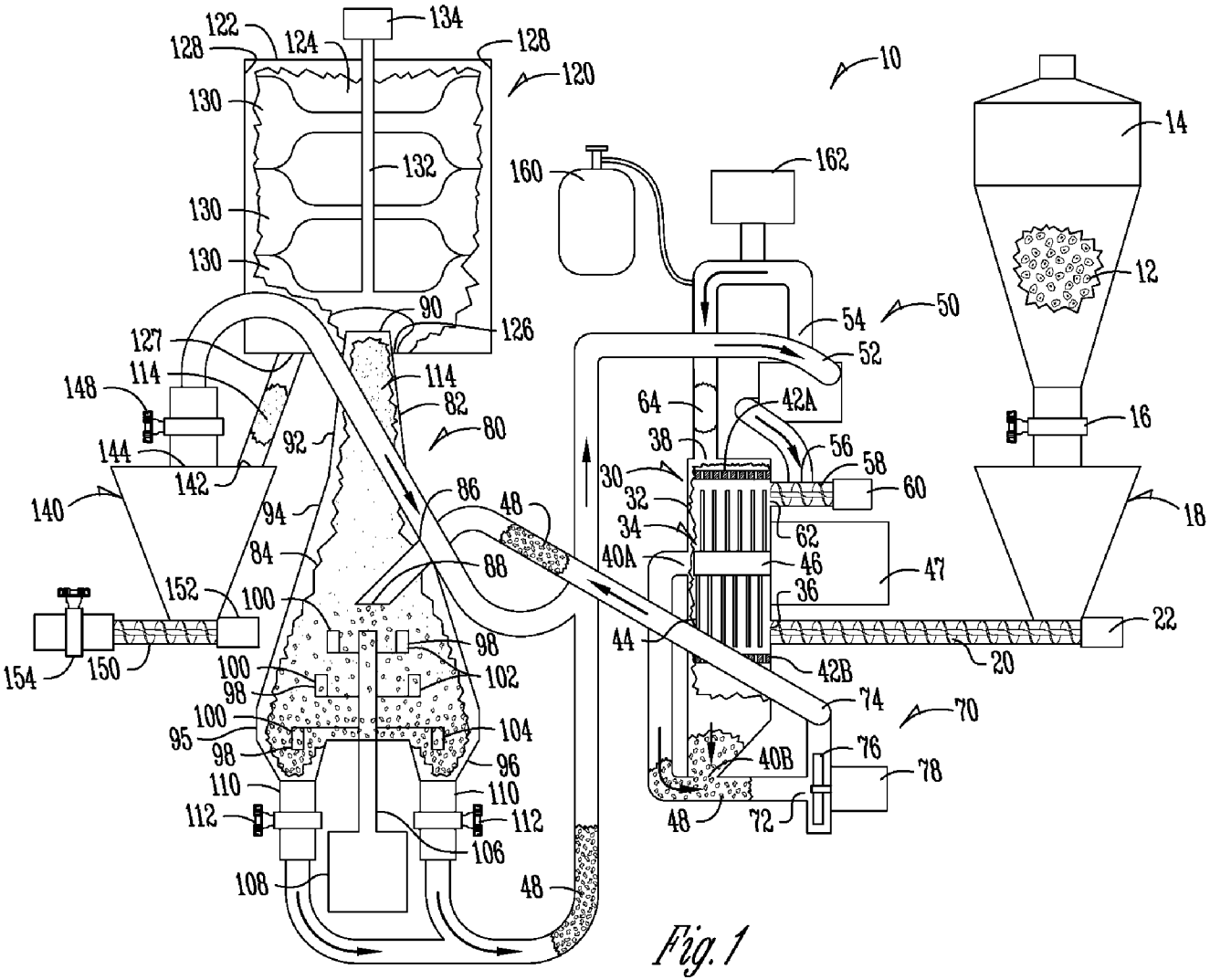
FIG. 1 is a plan layout of the granular material grinder.

The granular material grinder of this invention is referred to in FIG. 1 generally by the reference numeral 10. The granular material grinder 10 is used to grind whole grain, such as corn, soybeans, wheat, etc., or other products such as gravel or coal. The granular material grinder 10 grinds these granular products into a microground powder.

As seen in FIG. 1, the granular material grinder 10 of the present invention is completely sealed to the atmosphere. In this completely sealed configuration, the granular material grinder 10 operates with a 100% recovery of the granular material 12 placed into the granular material grinder 10. The grinder 10 could also be operated open to the atmosphere, however, in this configuration product is lost and a carrier gas such as nitrogen cannot be used.

Figure 2:
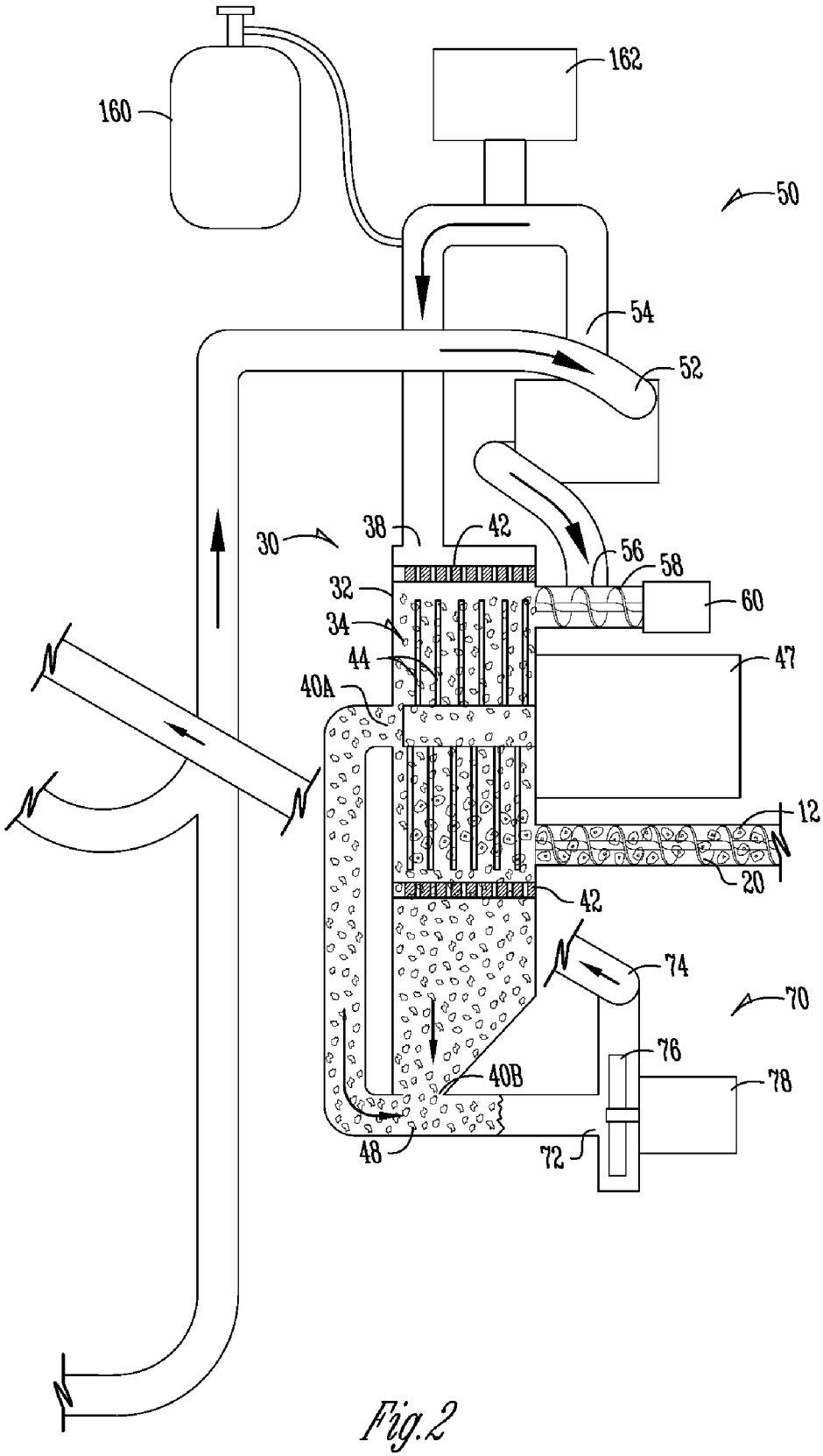
FIG. 2 is an enlarged view of the hammer mill as seen in FIG. 1.
Figure 3:
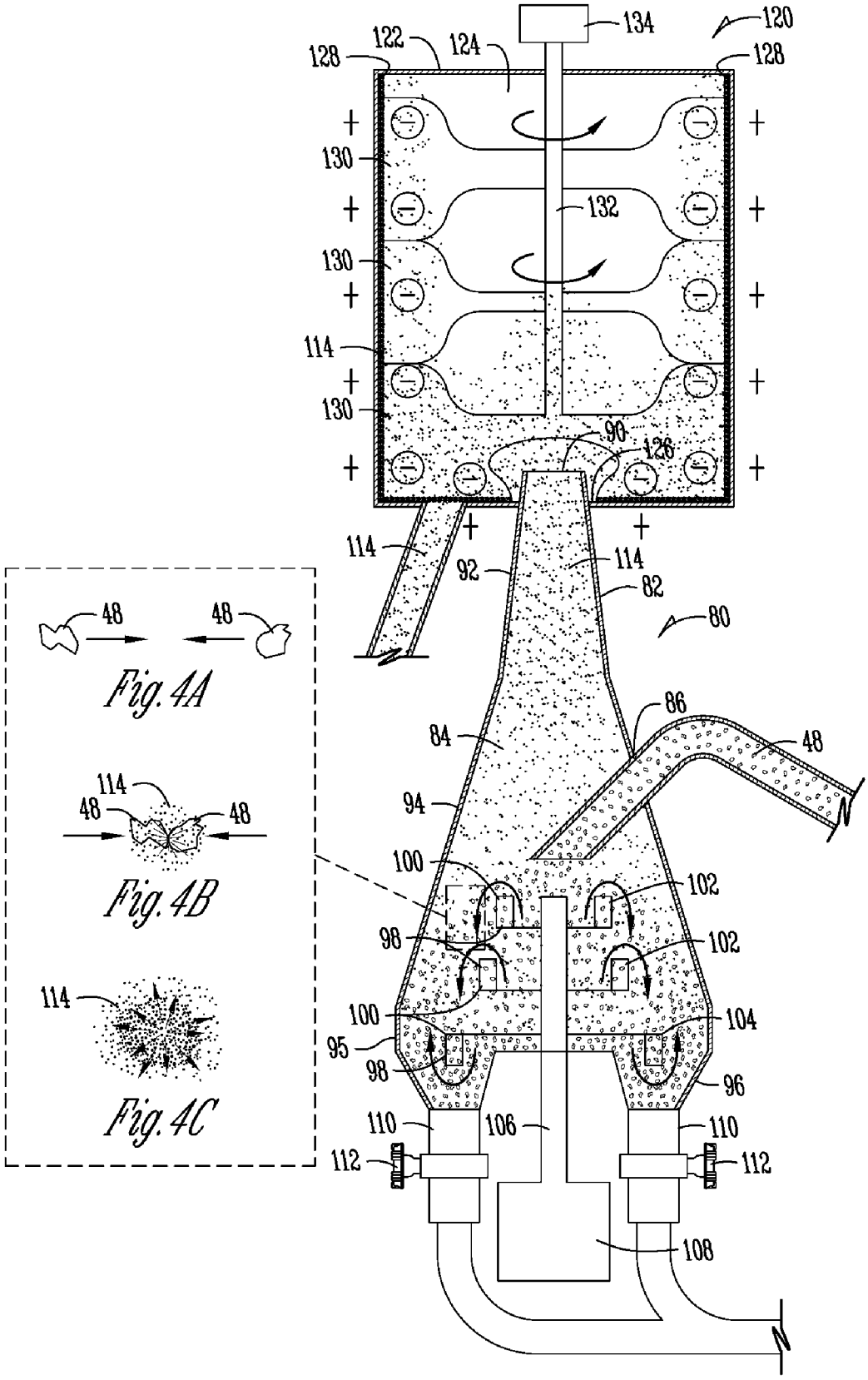
FIG. 3 is an enlarged view of the microgrinder and product collector as seen in FIG. 1.

As seen in FIGS. 1, 2, and 3 particulate matter 12 is placed in hopper 14 which is then sealed. Valve 16 is then opened allowing product to drop from the hopper 14 into a feed hopper 18. The valve 16 illustrated is a manually operated gate valve; however, the valve may be operated electronically, pneumatically or hydraulically and may be a butterfly gate or of another configuration.

The feed hopper 18 empties into an auger 20 which is powered by motor 22. The auger 20 pushes granular material 12 into the hammer mill 30. The hammer mill 30 has a hammer mill housing 32 having a chamber 34 therein. The hammer mill housing 32 has a granular material inlet 36 and a carrier gas inlet 38. The hammer mill housing 32 also has outlet 40A and 40B.

A screen 42 is placed within the carrier gas inlet 38 to increase the velocity of carrier gas passing through the hammer mill 30. Inside the hammer mill housing 32 are rotating hammers 44 attached to shaft 46 and driven by motor 47. The screen 42 also acts to keep the granular material 12 in contact with the hammers 44.

The auger 20 pushes granular matter 12 into the hammer mill housing 32. The drive motor 47 rotates hammers 44 to impact upon the granular matter 12 and reduces the size of the granular matter 12 through impact to produce particulate matter 48.

A mechanical separator 50 is provided to accelerate carrier gas 64 that is without any particulate matter. The mechanical separator 50 may be a blower or a cyclone separator. The mechanical separator 50 is adapted to receive a mixture of carrier gas and particulate matter that is being recycled through the system. The mechanical separator 50 receives this mixture through inlet 52 and separates the carrier gas 64 from the particulate matter 48. The mechanical separator 50 then moves the carrier gas through outlet 54 towards the carrier gas inlet 38 of the hammer mill 30. In addition, the mechanical separator 50 feeds the separated particulate matter 48 through the particulate matter outlet 56. An auger 58 is provided in fluid communication with particulate matter outlet 56 such that motor 60 turning the auger 58 places the particulate matter 48 from the particulate matter outlet 56 into the hammer mill 30 through recycled particulate matter inlet 62.

The carrier gas 64 generally has no significant particulate matter within it; however, the presence of particulate matter within the carrier gas 64 is not troublesome unless it is larger than the holes present in the screen 42. The carrier gas 64 enters the hammer mill 30 through the holes in the screen forcing product inward against the normal centrifugal force of the hammer mill 30 and out through outlet 40A and through screen 42 and through outlet 40B.

The velocity of the carrier gas 64 can be regulated by the number and size of the holes in screen 42 and the volume of carrier gas vacuumed through outlet 40A. The vacuum at outlet 40A is regulated by the revolutions per minute (RPM) of the fan motor 78. The greater the flow of carrier gas 64 the greater the velocity of the carrier gas 64 through the screen 42 in hammer mill 30. If the volume of carrier gas 64 remains constant, the larger the holes and/or the increase in number of holes in screen 42 will result in a lower velocity of carrier gas 64 through the hammer mill 30.

The more volume of carrier gas 64 through the hammer mill 30 the more cooling effect and the lower the operating temperature of the grinding process.

Fan 70 has an inlet 72 joined in fluid communication to outlets 40A and 40B by pipe having an inlet 72 and outlet 74 with fan blades 76 therebetween. The fan 70 is powered by fan motor 78. The fan 70 picks up particulate matter 48 that has gotten through the screen 42 and is dropping through the opening 40B. The combination of the two products from outlets 40A and 40B are then transferred by the fan 70 to a connecting pipe to a microgrinder 80. As shown in FIG. 1, only one microgrinder 80 is shown; however, in practice, several microgrinders 80 and particle collectors 120 may be used for each hammer mill 30 to increase the output of the system 10.

The microgrinder 80 has a column 82 with a cavity 84 with a microgrinder inlet 86 with a positioning pipe 88 mounted within the microgrinder inlet 86. The microgrinder inlet 86 is in fluid communication with the fan outlet 74.

The microgrinder 80 has a top section 92, a medial section 94, and a bottom section 96. The column 82 tapers downward from narrow to wide in the top section 92, a taper downward from narrow to wide in the medial section that is greater than the top sections taper, and a taper downward from wide to narrow in the bottom section 96. Alternatively, the top section 92 may be straight or tapered, larger at the top and small at the bottom. Alternatively, an optional straight section 95 between the medial section 94 and bottom section 96 may be used if more impellers are added to increase the displacement area of the impact zone.

Particulate matter 48 exits the positioning pipe 88 to strike at least one impeller 98 rotatably mounted in the column adjacent the microgrinder inlet 86. The impeller 98 has opposite sides, one of the sides having a plurality of impeller blades 100 thereon for accelerating particulate matter 48 and producing vortex and/or other formation in carrier gas 64. As shown in FIG. 1, three impellers 98 are located under the positioning pipe 88. Two impellers 98 indicated by 102 are facing upward. One impeller 98 identified with numeral 104 has its impeller blade 100 facing downward. All three impellers 98 are attached to shaft 106 and driven by motor 108. These impellers 98 produce vortexes; high and low pressure zones, and/or turbulence in which particulate matter 48 is exposed. The impellers 98 may be varied from upward or downward facing blades depending on the product being ground and the shape/size of vortex desired. In some instances, the impellers may have both upward and downward impeller blades.

As shown in FIGS. 4A-C, the particulate matter 48 is impacted against one another due to the different effects of vortexes, high and low pressure zones, and/or turbulence on various sized particulate matter 48.

The hammer mill 30 is the first grinding step. The hammer mill 30 produces a variety of sizes of particulate matter 48. The efficiency of the grinding process in the microgrinder 80 is improved by having varied size particles to impact with each other.

The desired result within the microgrinder 80 is to produce vortexes, high and low pressure zones, and/or turbulence at an intensity so that the larger particles pass through with little effect while the smaller particles will have their direction altered. The smaller particles are spun in a circular motion within the relatively small vortexes created within housing 82 causing them to cross paths with the larger particles and impact them.

These random collisions between particulate matter 48 cause the particulate matter 48 to fracture and reduce in size to microground product or powder 114. The random collisions are regulated by the speed and shape of the impellers 98 which are controlled by the RPM of motor 108. Adjustments may also be made by adjusting valves 112 which regulate recycled or regrind product particulate matter 48 and carrier gas 64. Adjustments to the valve 148 regulate the upward flow of carrier gas 64 and microground powder 114 into collection chamber 120.

Microground product or finely ground powder 114 moves upward partially because of static electricity, partially by upward movement of carrier gas 64 regulating by valve 148 and partially by the decreasing radius shape of housing 82.

Heavier particles work there way downward due to the shape of housing or column 82, because of gravity, because of the low velocity of the fluidized bed not being able to hold larger particles in suspension, and partially due to centrifugal force. The centrifugal force assists in the separation because larger particles are forced to the conical inner outer surface of the microgrinder 80 whereas the microground product 114 moves upward through the center core of the microgrinder 80.

Therefore, the three factors which affect the final grind are the impellers 98 shape, design, upward or downward position, and speed; the housing shape, design, and position relative gravity; and the flow of carrier gas 64 in the housing 82. The impeller design 98 is primarily responsible for the creation of the vortexes in the housing 82. Smaller vortexes hold smaller, lighter particles for a longer amount of time in an impact zone with larger particles providing the opportunity for finer, smaller particles sizes to be created.

The housing 82 can be matched to the impellers 98 to give some variance in the vortex size because the vortexes are formed in the space between impellers outer edges and the inner wall of the housing 82. By altering cones and rings upon the housing 82 the impact zone can be altered to obtain the desired effect in grinding efficiency. In addition, by increasing the flow of carrier gas 64 in the housing 82 the volume of microground powder 114 processed will increase. Particulate matter 48 may then be increased requiring more particulate matter 48 to be transported back to the hammer mill 30 through the recycled particulate matter 48 pipe. The carrier gas 64 flow in the housing 82 can be increased or decreased conversely by increasing or decreasing the cross sectional area or tapers changing the column 82 at any given point.

The granular material grinder 10 has a product collector 120 positioned above the microgrinder 80. The product collector has a shell 122 with a collection chamber 124 formed therein. The shell 122 having a collector inlet 126 and a collector outlet 127. The collector inlet 126 is in fluid communication with the microgrinder outlet 90. The product collector 120 has an inner surface 128. Wipers 130 attached to shaft 132 and driven by motor 134 clean microground product from the inner surface 128 of the product collector 120. The wipers 130 drop the microground powder 114 from the inner surface 128 to the product collector outlet 127 to the product hopper 140.

The product hopper 140 is in fluid communication with the collector outlet 127. The product hopper 140 has an inlet 142, a recycled outlet 144, and a valve 148 attached controlling the amount of carrier gas 64 leaving the outlet 144. Attached to the bottom of the product hopper 140 is an auger 150.

The product hopper 140 is filled thorough the normal operation of the wiper system. Opening valve 154 and rotating auger 150 by auger motor 152 fills a product bag (not shown). Valve 154 is then shut to replace a product bag. The valve 154 is closed between filling product bags to maintain the seal throughout the entire granular material grinding system.

Carrier gas 64 is recycled from the product hopper 140 back through the process where it joins with a mixture of particulate matter 48 and carrier gas exiting the recycled outlets 110 of the microgrinder 80. These combined recycled streams are in fluid communication with the recycled mixture inlet 52 of the mechanical separator 50. As mentioned previously, the mechanical separator 50 creates a stream of carrier gas 64 and a particulate matter stream that exits out the particulate matter outlet 56.

When operated in a closed loop, 90-100% of the entering granular material is recovered as microground product and preferably 98-100% of the entering granular material is recovered as microground product. When operated continuously 100% of entering granular material is converted to microground product.

The carrier gas 64 is recycled continually throughout the entire process. The carrier gas may be atmospheric air or an inert gas such as nitrogen. When using an inert gas the gas is entered into the process using a cylinder 160 of nitrogen gas connected to the piping of the granular material grinder 10. As shown, this nitrogen is attached at a point of the carrier gas outlet of the mechanical separator 50. However, the inert carrier gas may be placed into the system at other numerous places of the system. Alternatively, the carrier gas may be a reactionary gas chosen to change the chemical and/or physical properties of the microground product 114.

In addition, a refrigeration system 162 may be used to control the temperature of the carrier gas. Alternatively, a refrigerated cooling jacket may be around any portion of the system 10 or all of the system 10 to control temperature. The process is operated in a closed loop to maintain the system, particulate matter, microground powder and carrier gas between 50-100° F. and preferably between 50-70° F. These temperatures are preferred because of the reduced risk of degrading viable components of whole grain entering into the process. If the microground powder is a pharmaceutical, vitamin, or other neutraceutical there may be different preferred temperatures to protect the integrity of the microground powder. The refrigeration system is located at the carrier gas outlet of the mechanical separator 50 to minimize damage to the refrigeration system that may be encountered because of particulate matter entering the refrigeration system.

As shown, the granular material grinder 10 is manually controlled by adjusting the valves and RPM of the motors. Alternatively, a programmable control system may be employed to control the granular material grinder 10.

The invention has been shown and described above with the preferred embodiments, and it is understood that many modifications, substitutions, and additions may be made which are within the intended spirit and scope of the invention. In the foregoing, it can be seen that the present accomplishes at least all of its stated objectives.

What is claimed is:

1. A method of grinding particulate matter comprising:

suspending particulate matter in a flow of carrier gas;

transporting the particulate matter toward at least one impeller in a microgrinder;

propelling particulate matter using the impeller;

positioning the impeller such that the particulate matter propelled from the impeller impacts the particulate matter and fractures the particulate matter forming microground particles;

moving microground particles upward from the impellers into a collection chamber at least partially using static electricity;

collecting microground particles on an inner surface of the collection chamber of the microgrinder by electrostatic attraction; and rotating wipers along the inner surface of the collection chamber for wiping microground particles off of the inner surface of the collection chamber for collection.

2. The method of claim 1 further comprising the step circulating the particulate matter within a chamber of the microgrinder such that the particulate matter from the impeller impacts the circulating particulate matter and fractures the particulate matter.

3. The method of claim 1 further comprising separating microground particles from the particulate matter fractures in the microgrinder.

4. The method of claim 1 whereby separating is further accomplished by elevating the microground particles into the collection chamber in a fluidized bed using at least partially low speed velocity carrier gas.

5. The method of claim 1 further comprising transferring particulate matter fractures through closed-loop communication from the microgrinder to a mechanical breakage step.

6. The method of claim 5 further comprising the step reducing particulate matter fractures by mechanically impacting particulate matter fractures to form particulate pieces.

7. The method of claim 6 further comprising recycling particulate pieces through closed-loop communication to the microgrinder for reducing to micoground particles.

8. The method of claim 7 further comprising recycling the carrier gas through closed-loop transfer between the microground and mechanical breakage steps.

9. The method of claim 1 further comprising maintaining the temperature of the particulate matter between 50-100° F.

10. The method of claim 1 further comprising maintaining the temperature of the particulate matter below 50° F.

11. The method of claim 1 wherein the carrier gas is inert.

12. The method of claim 1 wherein the particulate matter is whole grain.

13. The method of claim 1 further comprising collecting microground particles wiped from off of the inner surface of the collection chamber into a product hopper.

* * * * *